US006540958B1

(12) United States Patent
Heinrich et al.

(10) Patent No.: US 6,540,958 B1
(45) Date of Patent: Apr. 1, 2003

(54) BELL AND HOPPER FOR SHAFT FURNACES

(75) Inventors: Peter Heinrich, Geldern (DE); Werner Otremba, Oberhausen (DE); Hartmut Hille, Moers (DE); Marko Ricke, Coesfeld (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/868,947

(22) PCT Filed: Dec. 11, 1999

(86) PCT No.: PCT/EP99/09808

§ 371 (c)(1),
(2), (4) Date: Jun. 22, 2001

(87) PCT Pub. No.: WO00/40762

PCT Pub. Date: Jul. 13, 2000

(30) Foreign Application Priority Data

Dec. 30, 1998 (DE) ..... 198 60 902
Mar. 16, 1999 (DE) ..... 199 11 637

(51) Int. Cl.[7] ..... C21B 7/08

(52) U.S. Cl. ..... 266/199; 266/197; 414/206; 414/208

(58) Field of Search ..... 266/197, 199; 414/206, 208

(56) References Cited

U.S. PATENT DOCUMENTS 1,531,788 A 3/1925 Jefferson
3,780,890 A * 12/1973 Glover ..... 414/170
4,040,530 A * 8/1977 Mahr et al. ..... 414/206
4,322,197 A * 3/1982 Mahr et al. ..... 414/208
5,299,900 A * 4/1994 Mailliet et al. ..... 266/199

FOREIGN PATENT DOCUMENTS

| | | |
|---|---|---|
| DE | 2222386 | 11/1973 |
| FR | 2216350 | 8/1974 |
| FR | 2230246 | 12/1974 |
| GB | 2027860 | 2/1980 |

OTHER PUBLICATIONS

Patent Abstracts of Japan, vol. 008, No. 052 (C–213), Mar. 9, 1984 & JP 58 210105 A (Shin Nippon Seitetsu KK) Dec. 7, 1983.

* cited by examiner

*Primary Examiner*—Scott Kastler
(74) *Attorney, Agent, or Firm*—Friedrich Kueffner

(57) ABSTRACT

In order to configure a bell and hopper for shaft furnaces, in particular, blast furnaces, comprising a charging bin with a feed tube, a rotating chute carrier with rotary drive, a swiveling chute in the interior of the furnace with drive means arranged external to a housing, in a less failure-prone and a wear resistant way, the drive means for the swivel movement of the chute are to comprise: at least one motor (7) which drives by a respective pinion (8) a crown gear (9), wherein the crown gear (9) engages the spindle gear wheels (11) of at least two spindles (13) distributed about the periphery of the bell and hopper external to the rotating chute carrier (3) for generating a lifting and lowering movement of the spindles, as well as means (14, 15, 17, 21) for transmitting this vertical movement of the spindles onto the tilting shafts (22), which penetrate the inner wall (24) of the chute carrier (3) and from which the chute can be suspended, for generating a swivel and tilting movement of the chute.

9 Claims, 2 Drawing Sheets

BELL AND HOPPER FOR SHAFT FURNACES

BACKGROUND OF THE INVENTION

1. Field of the Invention

The invention relates to a bell and hopper for shaft furnaces, in particular, blast furnaces, comprising a charging bin with a feed tube, a rotating chute carrier with a rotary drive, and a swiveling chute in the furnace interior with drive means arranged externally.

2. Discussion of Related Art

A bell and hopper of the aforementioned kind is described in German patent application 197 09 329.9. It is a bell and hopper without cone wherein the drives for the rotating and tilting movement of the chute carrier and of the chute operate independently from one another and are not in connection with the furnace interior. The chute carrier supported in a ball bearing slewing ring has a rotary drive which is comprised of an electric motor, pinion, and crown gear. The drive means for the tilting movement is disclosed in the form of a hydraulic pressure cylinder entrained in rotation by the chute carrier.

This entrainment of the tilting drive on the rotating chute carrier of the bell and hopper exhibits in the practical embodiment the disadvantage that a complex, expensive, and failure-prone energy transmission onto the rotating part is required, for example, by slip rings.

From OS 2404647 a device for driving or moving a device for loading a blast furnace with raw materials is known. In this connection, a distribution delivery shoot or chute is connected with the lower ends of an inner cylinder and an outer cylinder which are supported so as to be simultaneously rotatable, moveable axially relative to one another and independently from one another. The distribution delivery shoot is rotatable together with the inner and outer cylinders and is tiltable with the vertical movement of the inner cylinder relative to the outer cylinder. The vertical movement is achieved with several pressure cylinders. The distribution delivery chute is swivelingly supported at the lower end of the inner cylinder by means of a pivot bolt and is connected by means of joint parts with the lower end of the outer cylinder. The distribution delivery shoot is swivelled by moving the outer cylinder vertically relative to the inner cylinder. The described drive is an overlaid rotation and tilting movement of the chute.

Based on this prior art, it is an object of the invention to provide a bell and hopper of the aforementioned kind which is less failure-prone, is wear-resistant as well as cost-efficient.

SUMMARY OF THE INVENTION

This object is solved by the bell and hopper according to the invention, comprising a charging bin with a feed tube, a rotating chute carrier with a rotary drive unit, a swiveling chute in the furnace interior with drive means arranged externally to the housing, wherein the drive means for swivel movement of the chute (1) comprise:

at least one motor (7) which drives by a respective pinion (8) a crown gear (9), wherein the crown gear (9) engages the spindle gear wheels (11) of at least two spindles (13) distributed about the periphery of the bell and hopper external to the rotating chute carrier (3) for generating a lifting and lowering movement of the spindles, as well as means (14, 15, 17, 21) for transmitting this vertical movement of the spindles onto tilting shafts (22), from which the chute is suspendable and which penetrate the inner walls (24) of the chute carrier (3), for generating a swivel and tilting movement of the chute.

As a solution it is suggested that the drive means for the swivel movement of the chute comprise at least one motor which drives a crown gear by means of a pinion, respectively, wherein the crown gear engages the spindle gear wheels of at least two spindles distributed about the periphery of the bell and hopper externally to the rotating chute carrier for generating a lifting and lowering movement of the spindles, as well as means for transmitting this vertical movement of the spindles to the tilting shafts, which penetrate the inner housing wall and in which the chute can be suspended, for generating a swivel and tilting movement of the chute.

In this way it is possible to overcome the disadvantages of the drive being entrained in rotation for the tilting movement of the chute while, at the same time, having the advantages of a separate arrangement of the two drives of rotating and tilting movement of the chute. In comparison to the solution known from German patent application 197 09 329.9, the actual drive means for generating the tilting movement of the chute are no longer entrained in rotation. Only the parts of the less failure-prone means for movement transmission rotate.

In contrast to the solution according to OS 2404647, according to the invention a synchronized movement of the lifting device is achieved; a canting or jamming is no longer possible.

The means for movement transmission between the spindles and the chute is in the form of a lifting frame as well as a lifting ring wherein the lifting frame is entrained corresponding to the vertical movement of the spindle nut and the lifting ring is entrained corresponding to the vertical movement of the lifting frame. On the lifting ring joint parts are provided which transform, by eccentric engagement on the tilting shafts, the lifting and lowering movement of the lifting ring into a corresponding rotational movement of the tilting shafts. For this purpose, the tilting shafts have means at their first end for suspending the chute and an area, extending at a right angle to the shaft axis, at their second end for connection with the joint parts.

In an especially preferred embodiment three spindles are provided which ensure an especially canting-free drive. With the inventive arrangement of the drive means as well as the selection of the drives, a complete synchronization of the lifting spindles and thus an absolute uniform, non-canting lifting and lowering of the lifting ring and thus a minimal failure liability are made possible.

For ensuring a minimal wear, it is suggested to close off the drive means for the rotational and swivel movement of the chute carrier or the chute by means of a lid which is placed onto the housing. The resulting inner space is preferably filled with nitrogen.

In this way, the drive elements remain dust-free which is advantageous in regard to their service life. The drive means are less easily accessible; however, the employed seals are no longer exposed to the full differential pressure between the gas pressure at the furnace head and the atmospheric pressure but only to the minimal setpoint differential pressure. By means of the solution with the lid it is possible to produce in the interior of the housing by means of nitrogen a gas pressure which is somewhat greater than the pressure in the furnace interior. The pressure is automatically controllable. With this embodiment, the seals, as they are known from the German patent application 197 09 329.9, can be embodied less complex. Possible damage at the seals would result in an increase of the otherwise very minimal nitrogen consumption and would be detected immediately.

BRIEF DESCRIPTION OF THE DRAWINGS

Further details of the invention result from the following description. It is shown here in.

DESCRIPTION OF PREFERRED EMBODIMENTS

Figure 1:
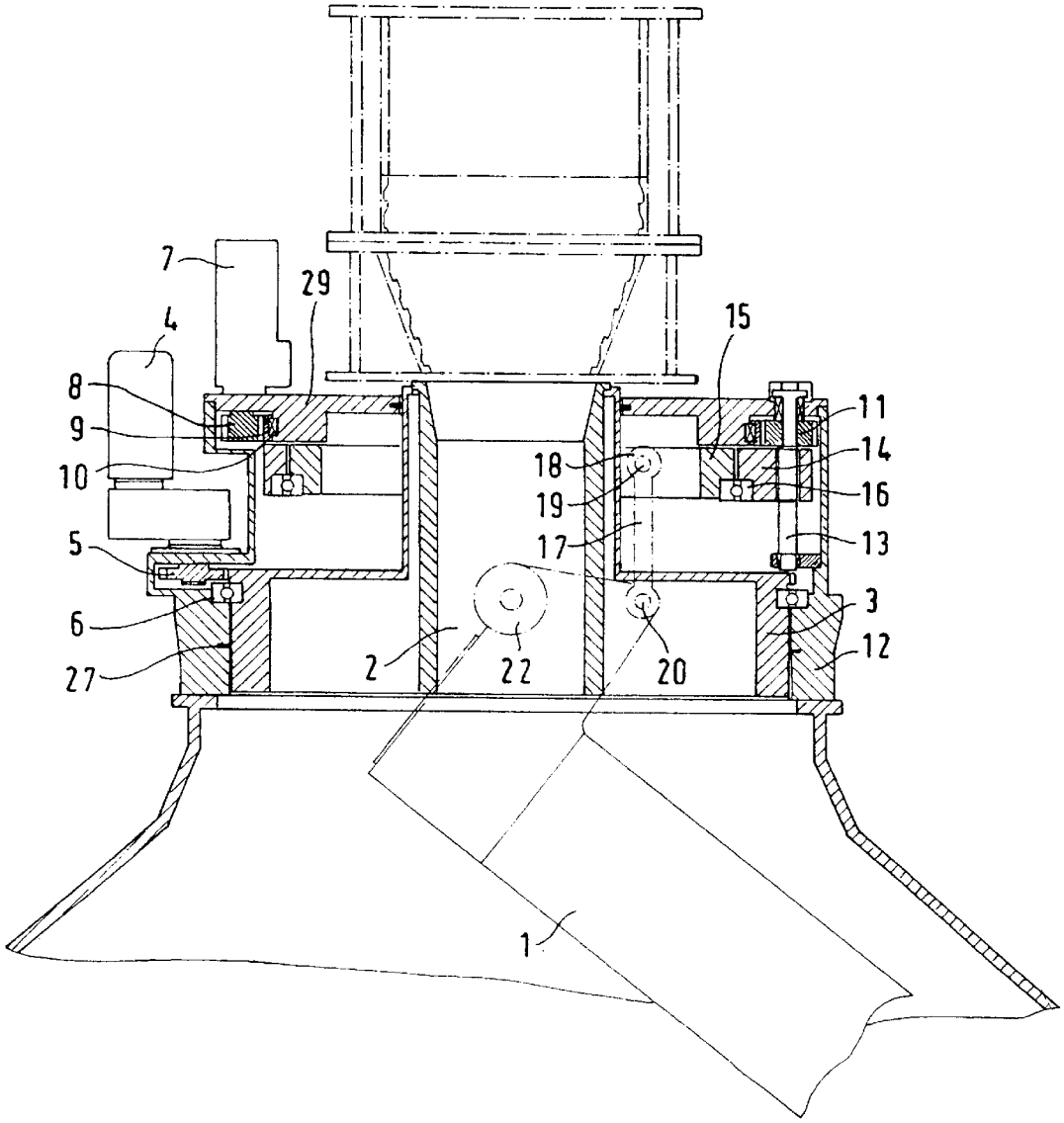
FIG. 1 a side view of the bell and hopper.
Figure 2:
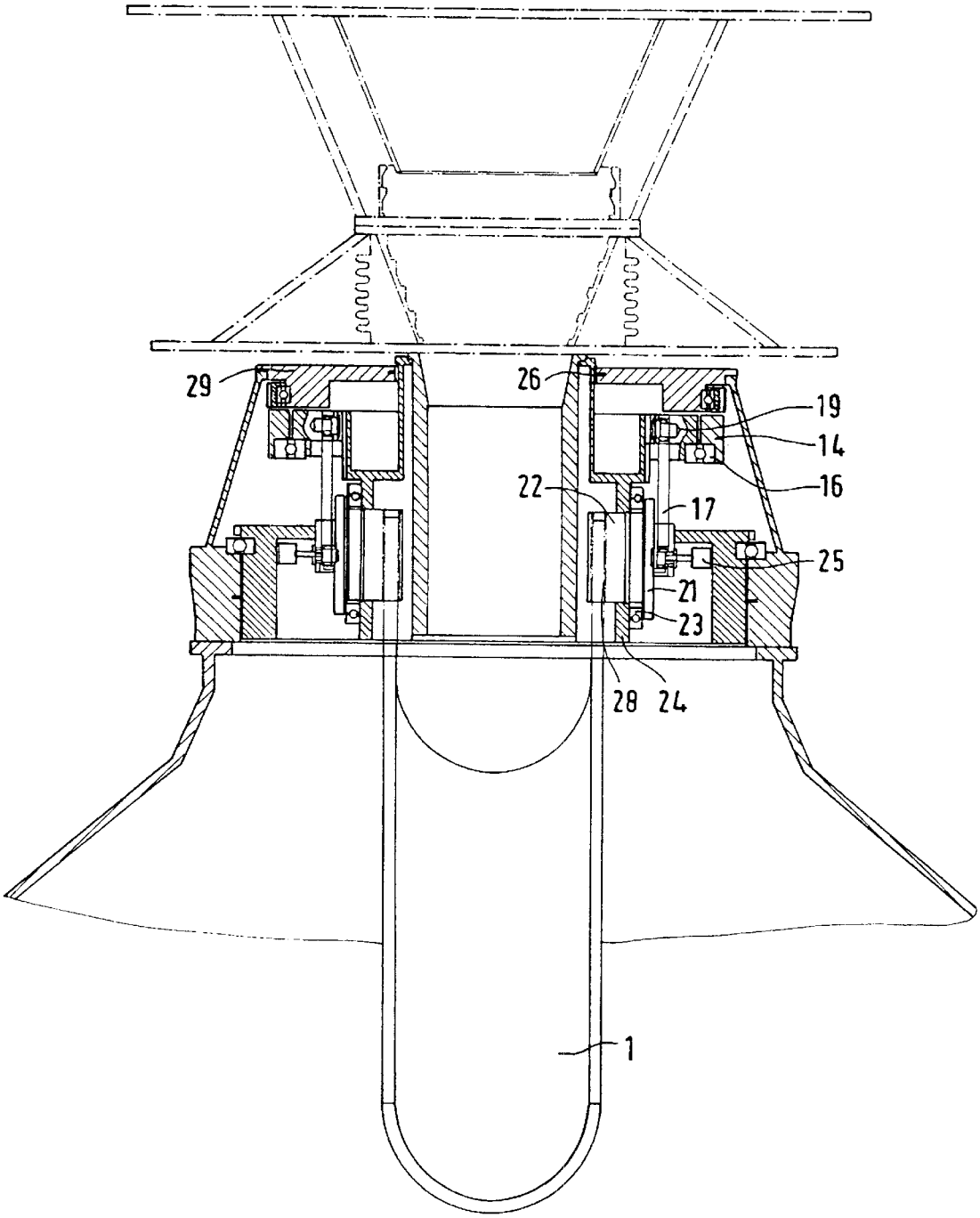
FIG. 2 a front view of the bell and hopper.

FIG. 1 shows a bell and hopper with rotatable and tiltable chute 1 for loading a blast furnace. The burden is supplied from a feed storage into a charging bin(schematically illustrated) positioned underneath. The burden, coming from the charging bin, moves via the feed tube 2 onto a tiltable and rotatable chute 1 arranged within the chute carrier and from here to the upper part of the blast furnace.

The chute carrier 3 with chute is rotated by a rotary drive, comprised of a motor 4, a pinion 5, as well as crown gear 6.

For generating the tilting movement a further motor 7 is provided which drives a crown gear 9 via a pinion 8. The drive elements are supported by means of the bearing 10. The crown gear 9 drives the respective spindle gear wheel 11 of three spindles 13 distributed about the periphery of the bell and hopper housing 12. As a result of the rotational movement, the spindle nut is lifted and lowered and entrains thus the lifting frame 14 arranged adjacently thereto. The lifting ring 15 is arranged adjacent to the lifting frame. The vertical movement of the lifting frame 14 is transmitted onto the lifting ring 15 while a bearing 16 positioned laterally underneath the lifting ring takes up the rotational movement of the lifting ring. The first end 18 of the joint parts 17 are detachably fastened and supported (19) on the lifting ring 15. The second end 20 of the joint parts 17 is detachably connected to a connecting part 21 of the tilting shafts 22. The engagement of the joint parts 17 on the connecting part 21 of the tilting shafts 22 is eccentric so that the vertical movement of the lifting ring 15 is transformed into a corresponding rotational movement of the tilting shafts 22. The tilting shafts 22 are supported in bearings 23. They penetrate gas-tightly the inner wall 24 of the chute carrier 3. The inwardly oriented end 28 of the tilting shafts 22 is configured such that the rotational chute 1 can be suspended therefrom. In this connection, a locking of the chute 1, which may be beneficial for safety reasons, can be realized by short stroke cylinders 25. The upper and lower annular seals are identified by 26 and 27.

The housing 12 and the drive means are embodied to be closeable by the lid 29 and to be gas-tight. The inner pressure can be controlled by filling in nitrogen.

What is claimed is:

1. Charging device for a shaft furnace, comprising a charging bin that is stationary and a feed tube (2), as well as a chute carrier (3) that is rotatable by means of a rotary drive (4–6) and a chute (1) connected with the chute carrier (3), wherein the chute (1) has a swivel drive comprising a motor (7) arranged externally to a stationary housing (12), wherein the motor (7) drives via a pinion (8) a crown gear (9), wherein the crown gear (9), via a gear wheel movement, effects a rotary spindle movement and thus a lifting and lowering movement of a spindle nut, which by means of liftable and lowerable transmission means (14, 15, 17, 21) swivels the chute (1), wherein the crown gear (9) engages spindle gear wheels (11) of at least two spindles (13), wherein the spindles (13) are fixedly supported on the housing about the periphery of the charging device and load a non-rotating lifting frame (14), relative to which a lifting ring (15), connected to the chute (1) by further transmission means for swiveling the chute (1), is rotatable.

2. Charging device according to claim 1, wherein the chute carrier has an inner wall (24) which is penetrated by tilting shafts (22) from which the chute (1) is suspendable.

3. Charging device according to claim 2, wherein the transmission means comprise joint pieces (17) which are connected to the lifting ring (15) and which transform, by eccentric engagement on the tilting shafts (22), the lifting and lowering movement of the lifting ring (15) into a corresponding rotational movement of the tilting shafts (22).

4. Charging device according to claim 2, wherein the tilting shafts (22) at their first end (28) have means for suspending the chute (1) and at their second end have an area (21), extending at a right angle to the shaft axis, for connecting to the joint pieces (17).

5. Charging device according to claim 4, wherein hydraulic cylinders (25) are provided for locking the rotary chute (1) suspended on the tilting shafts (22).

6. Charging device according to claim 1, wherein the drive means for the rotary and swivel movement of the chute carrier or the chute can be sealed by a lid (29) and the resulting inner space is loadable with a gas whose pressure is maintained automatically always above the pressure in the furnace chamber.

7. Charging device according to claim 1, wherein three spindles (13) are provided.

8. Charging device according to claim 1, wherein a bearing (16) is arranged laterally below the lifting ring (15) for taking up the rotational movement of the lifting ring.

9. Charging device according to claim 1, wherein the rotary drive is comprised of a motor (4), a pinion (5), and crown gear (6).

* * * * *